US010234201B2

(12) United States Patent
Kim et al.

(10) Patent No.: US 10,234,201 B2
(45) Date of Patent: Mar. 19, 2019

(54) COMPLEX TYPE DRYER FOR HIGH VISCOUS MATERIALS

(71) Applicant: KOREA INSTITUTE OF ENERGY RESEARCH, Daejeon (KR)

(72) Inventors: Sung-il Kim, Daejeon (KR); Jong-Won Choi, Daejeon (KR); Sang-Hyun Oh, Cheongju-si (KR); Kye-Jong Lee, Daejeon (KR)

(73) Assignee: Korea institute of energy research, Daejeon ( * ) Notice: Subject to any disclaimer, the term of this patent is extended or adjusted under 35 U.S.C. 154(b) by 516 days.

(21) Appl. No.: 14/929,718

(22) Filed: Nov. 2, 2015

(65) Prior Publication Data

US 2016/0252302 A1 Sep. 1, 2016

(30) Foreign Application Priority Data

Feb. 26, 2015 (KR) ..... 10-2015-0027379

(51) Int. Cl.

| | |
|---|---|
| ***F26B 11/02*** | (2006.01) |
| ***F26B 25/00*** | (2006.01) |
| ***F26B 3/20*** | (2006.01) |
| ***F26B 17/28*** | (2006.01) |
| ***F26B 21/00*** | (2006.01) |

(52) U.S. Cl.

CPC ..... *F26B 25/001* (2013.01); *F26B 3/20* (2013.01); *F26B 17/284* (2013.01); *F26B 17/286* (2013.01); *F26B 21/004* (2013.01); *F26B 2200/18* (2013.01)

(58) Field of Classification Search

CPC ..... F26B 3/20; F26B 21/02; F26B 25/001; F26B 17/284; F26B 17/286; F26B 21/004; F26B 2200/18; B29D 7/01; B29D 7/00

USPC ..... 34/122

See application file for complete search history.

(56) References Cited

U.S. PATENT DOCUMENTS

| | | | | |
|---|---|---|---|---|
| 2,282,009 A * | 5/1942 | Talbot | B29D 7/01 | 159/10 |
| 2,562,358 A * | 7/1951 | Huebner | B29D 7/01 | 101/DIG. 37 |
| 3,264,753 A * | 8/1966 | Budzien | F26B 17/286 | 159/10 |
| 4,894,927 A * | 1/1990 | Ogawa | F26B 3/283 | 34/507 |

(Continued)

*Primary Examiner* — Kenneth Rinehart
*Assistant Examiner* — Bao D Nguyen
(74) *Attorney, Agent, or Firm* — LEEPI

(57) ABSTRACT

A complex type dryer includes a rotational cylinder, a drying material, a hot air provider, a hot air chamber and a scraping unit. The drying material provider is disposed over the rotational cylinder and coats a drying material on a surface of the rotational cylinder. The hot air provider is connected to both sides of the rotational cylinder, and includes first and second hot air tubes. The first and second hot air tubes alternately provide a hot air into the rotational cylinder or alternately exhaust the hot air passing through the rotational cylinder. The hot air chamber is disposed along an outer surface of the rotational cylinder outside of the rotational cylinder. The scraping unit is disposed at a side of the rotational cylinder, and removes the drying material from the surface of the rotational cylinder after dried by the rotational cylinder and the hot air chamber.

16 Claims, 12 Drawing Sheets

(56) References Cited

U.S. PATENT DOCUMENTS

| | | | | |
|---|---|---|---|---|
| 7,025,123 | B1 * | 4/2006 | Gerndt | F28F 5/02 165/90 |
| 2007/0130793 | A1 * | 6/2007 | Hada | F26B 13/16 34/454 |

* cited by examiner

COMPLEX TYPE DRYER FOR HIGH VISCOUS MATERIALS

PRIORITY STATEMENT

This application claims priority under 35 U.S.C. § 119 to Korean Patent Application No. 10-2015-0027379, filed on Feb. 26, 2015, and all the benefits accruing therefrom, the content of which is herein incorporated by reference in its entirety.

BACKGROUND

1. Field of Disclosure

The present disclosure of invention relates to a complex type dryer in which indirect heating and direct heating are mixed. More particularly, the present disclosure of invention relates to a complex type dryer for high viscous materials in which high viscous materials having relatively high viscosity and adhesiveness are accurately and precisely provided with a thickness between several hundred micrometers and several millimeters and are dried.

2. Description of Related Technology

High viscous materials such as a microalgae, an aerogel paste, a sewage sludge and so on having micro particles with a micrometer unit size, are dried so as to remove water thereinside, and then are widely used. Thus, various kinds of dryers for drying the high viscous materials have been developed.

For example, Japanese laid-open application No. 2001-47841 discloses a drying apparatus in which viscous materials are provided between agitation wings due to a rotation of the agitation wings to be dried. However, in the drying apparatus in which the agitation wings rotate, the viscous materials adhere to the agitation wings and thus additional cleaning processes should be regularly performed and the drying may be less efficient.

To prevent the viscous materials from adhere to the agitation wings, Japanese laid-open application No. 2005-303999 discloses a drying apparatus further comprising an agitation holder which freely rotates inside of a drying drum. However, when the agitation holder is additionally added, the freely rotating agitation holder is hard to be uniformly controlled and thus the drying or the agitation may be less efficient.

Further, Korean laid-open application No. 10-2013-0063966 discloses that materials are induced to adhere to an outer surface of a rotational cylinder for drying. However, the drying merely depends on an absorbing element combined on an inner surface of the rotational cylinder, and thus the drying may be less efficient and the absorbing element should be regularly changed.

SUMMARY

The present invention is developed to solve the above-mentioned problems of the related arts. The present invention provides a complex type dryer for high viscous materials capable of increasing a drying efficiency for the high viscous materials and solving systemic problems occurring in drying the high viscous materials.

According to an example embodiment of a complex type dryer, the complex type dryer includes a rotational cylinder, a drying material, a hot air provider, a hot air chamber and a scraping unit. The drying material provider is disposed over the rotational cylinder and coats a drying material on a surface of the rotational cylinder. The hot air provider is connected to both sides of the rotational cylinder, and includes first and second hot air tubes. The first and second hot air tubes alternately provide a hot air into the rotational cylinder or alternately exhaust the hot air passing through the rotational cylinder. The hot air chamber is disposed along an outer surface of the rotational cylinder outside of the rotational cylinder. The hot air which is re-provided after passing through the rotational cylinder passes through the hot air chamber. The scraping unit is disposed at a side of the rotational cylinder, and removes the drying material from the surface of the rotational cylinder after dried by the rotational cylinder and the hot air chamber.

In an example embodiment, a first guide pin may be formed inside of the rotational cylinder and may guide the hot air alternately provided by the first and second hot air tubes. A hot air inlet may be arranged at both sides of the rotational cylinder, and the hot air provided by the first and second hot air tubes may flow in through the hot air inlet.

In an example embodiment, the hot air inlet may be arranged in a zigzag shape along a circumference of both sides of the rotational cylinder connected to the first and second hot air tubes.

In an example embodiment, the drying material provider may include a slit and a nozzle part. The slit may be disposed at an end portion of the drying material provider and the drying material may flow out through the slit. The nozzle part may be fixed to at a side of the slit and coats the drying material to be a thin film on the surface of the rotational cylinder. The nozzle part may have a sector shape cross-section and an end portion of the nozzle part may be spaced apart from the surface of the rotational cylinder by a predetermined distance.

In an example embodiment, the nozzle part may include a heating part disposed inside of the nozzle part and provide a heat to the nozzle part.

In an example embodiment, the heating part may be a heating plate or a heating line.

In an example embodiment, an insulating part may be formed at both sides of the nozzle part to prevent the heat from dissipating to outside.

In an example embodiment, the complex type dryer may further include a connecting part receiving the hot air passing through the rotational cylinder and re-providing the heat to the hot air chamber. The hot air may be sequentially provided to the first hot air tube, the rotational cylinder, the second hot air tube, the connecting part and the hot air chamber, which is a first path, or the hot air may be sequentially provided to the second hot air tube, the rotational cylinder, the first hot air tube, the connecting part and the hot air chamber, which is a second path.

In an example embodiment, the complex type dryer may further include a path controller controlling the hot air path to provide the hot air alternately along the first and second paths.

In an example embodiment, the hot air may be provided only to the hot air chamber without passing through the rotational cylinder, which is a third path, or the hot air may be sequentially provided to the first hot air tube, the rotational cylinder and the second hot air tube, which is a fourth path.

In an example embodiment, the hot air chamber may include an inlet portion through which the hot air flows in, an outlet portion through which the hot air flows out, and a body portion between the inlet and outlet portions and through which the hot air passes. The body portion may cover between a half and three quarters of the outer surface of the rotational cylinder.

In an example embodiment, the hot air chamber may further include a porous block disposed at the inlet portion to increase uniformity of the hot air flowing in the hot air chamber.

In an example embodiment, the scraping unit may include a scraper removing the drying material, and a fixing part fixing the scraper which is detachable.

In an example embodiment, the scraping unit may be disposed between the drying material provider and an end portion of the hot air chamber. The fixing part may apply a force to the scraper to stick the scraper fast to the rotational cylinder.

In an example embodiment, the complex type dryer may further include a cover unit covering the side of the rotational cylinder and a side of the hot air chamber at the same time to enclose a space between the rotational cylinder and the hot air chamber.

In an example embodiment, the rotational cylinder further may include an enclosing part fixing to a side surface of the rotational cylinder and making contact with the cover unit, to enclose a space between the rotational cylinder and the cover unit.

In an example embodiment, the enclosing part may include a bearing inducing the rotational cylinder to rotate with respect to the cover unit.

In an example embodiment, the rotational cylinder may further include a light emitting unit disposed inside of the rotational cylinder and provide a radiant energy toward the surface of the rotational cylinder.

In an example embodiment, the complex type dryer may further include a light emitting cover covering the hot air chamber outside of the hot air chamber, and providing a radiant energy toward the surface of the rotational cylinder.

According to the example embodiments of the present invention, the hot air is alternately provided from the rotational cylinder by the hot air provider, to prevent the drying material from be ununiformly dried due to the hot air from one side of the rotational cylinder, and thus the drying material may be dried more uniformly.

The first and second hot air tubes are respectively connected to both sides of the rotational cylinder, and the providing and the exhausting of the hot air to the first and second hot air tubes are controlled, so that the drying material may be more effectively dried.

The path of the hot air may be controlled toward the rotational cylinder or toward the hot air chamber based on user's selection, and thus the drying material may be more effectively dried.

In addition, the hot air inlet is arranged by a zigzag shape at both sides of the rotational cylinder, and thus the hot air may flow in the rotational cylinder more efficiently.

In addition, an end portion of the nozzle part coating the drying material on the surface of the rotational cylinder is sharped, and the heating part is inserted into the nozzle part, so that the drying material may be heated and dried firstly. Thus, the drying material may be coated on the surface of the rotational cylinder more uniformly.

The heating part includes a heating plate or a heating line providing the heat, and the heat may be prevented from being dissipated by the insulating part. Thus, the energy may be less lost.

In addition, the hot air chamber covers between a half and three quarters of the outer surface of the rotational cylinder, which is relatively larger covering area, and thus the drying material coated on the rotational cylinder may be dried more efficiently.

In addition, the scraper of the scraping unit is detachable, and thus the scraper may be easily repaired or changed. A uniform force is applied to the scraper, and thus the drying material may be uniformly and effectively removed.

In addition, the cover unit encloses the space between the rotational cylinder and the hot air chamber to minimize leakage of the hot air, and thus the moisture evaporated from the drying material is easily exhausted without a drop of temperature and the drying material may be dried more efficiently.

The side surface between the cover unit and the rotational cylinder is enclosed by the enclosing part to minimize the leakage of the hot air, and the enclosing part includes a bearing and thus the rotational cylinder rotates with respect to the cover unit.

In addition, the light emitting unit is inside of the rotational cylinder and a radiant energy is provided to the surface of the rotational cylinder, and thus the drying material may be dried more efficiently. Here, a quantity of the radiant energy and the hot air may be controlled to dry the drying material more efficiently.

In addition, the light emitting cover covering the outside of the hot air chamber provides the radiant energy to the drying material of the rotational cylinder, and thus the drying material may be dried more efficiently.

BRIEF DESCRIPTION OF THE DRAWINGS

The above and other features and advantages will become more apparent by describing exemplary embodiments thereof with reference to the accompanying drawings, in which.

DETAILED DESCRIPTION

Hereinafter, exemplary embodiment of the invention will be explained in detail with reference to the accompanying drawings.

Figure 1:
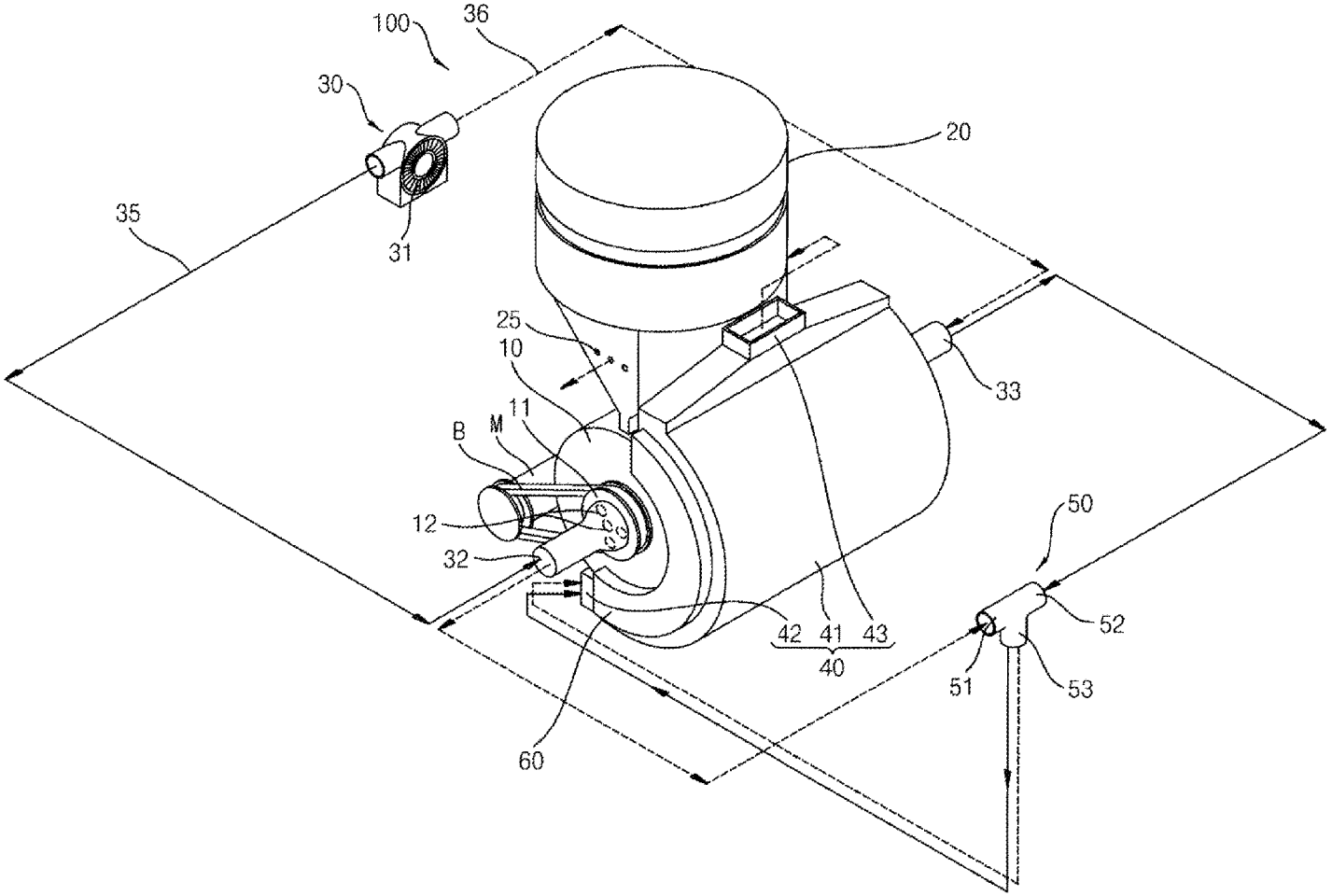
FIG. 1 is a perspective view illustrating a complex type dryer according to an example embodiment of the present invention.
Figure 2:
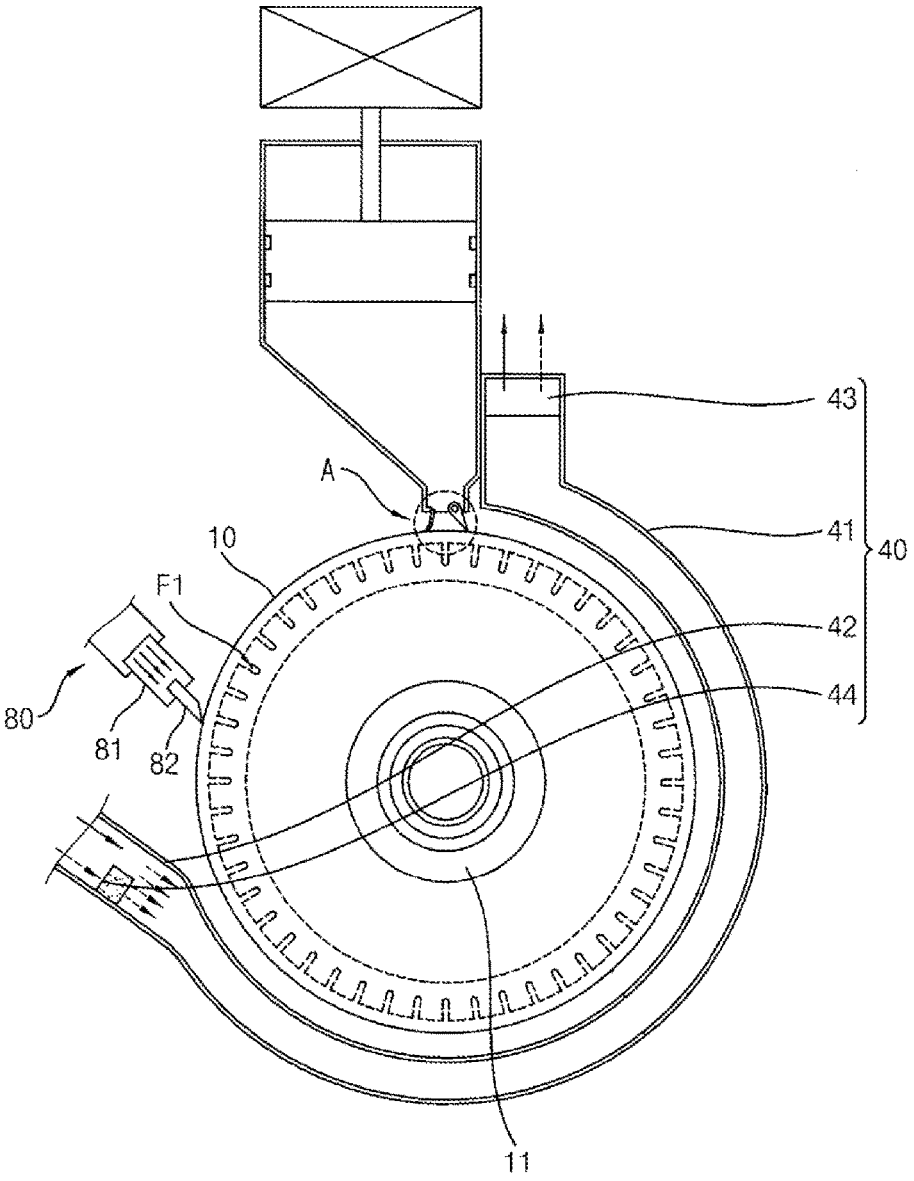
FIG. 2 is a cross-sectional view illustrating the complex type dryer in FIG. 2.
Figure 3:
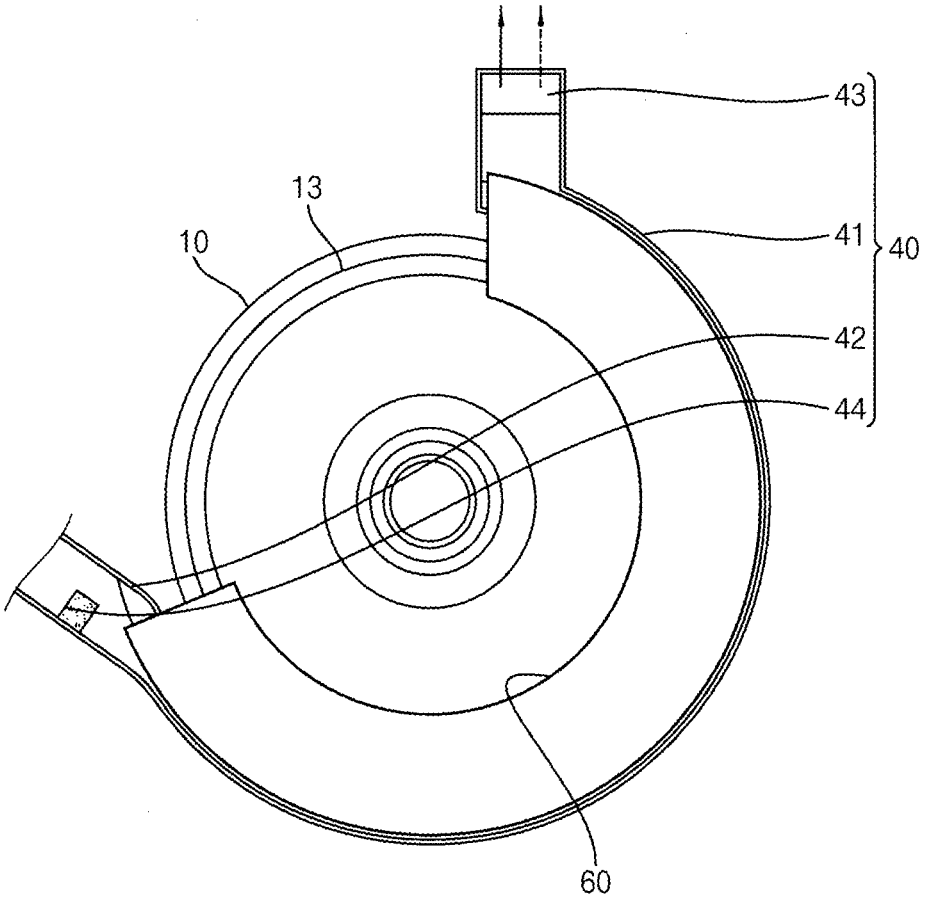
FIG. 3 is a side view illustrating the complex type dryer in FIG. 3.
Figure 4:
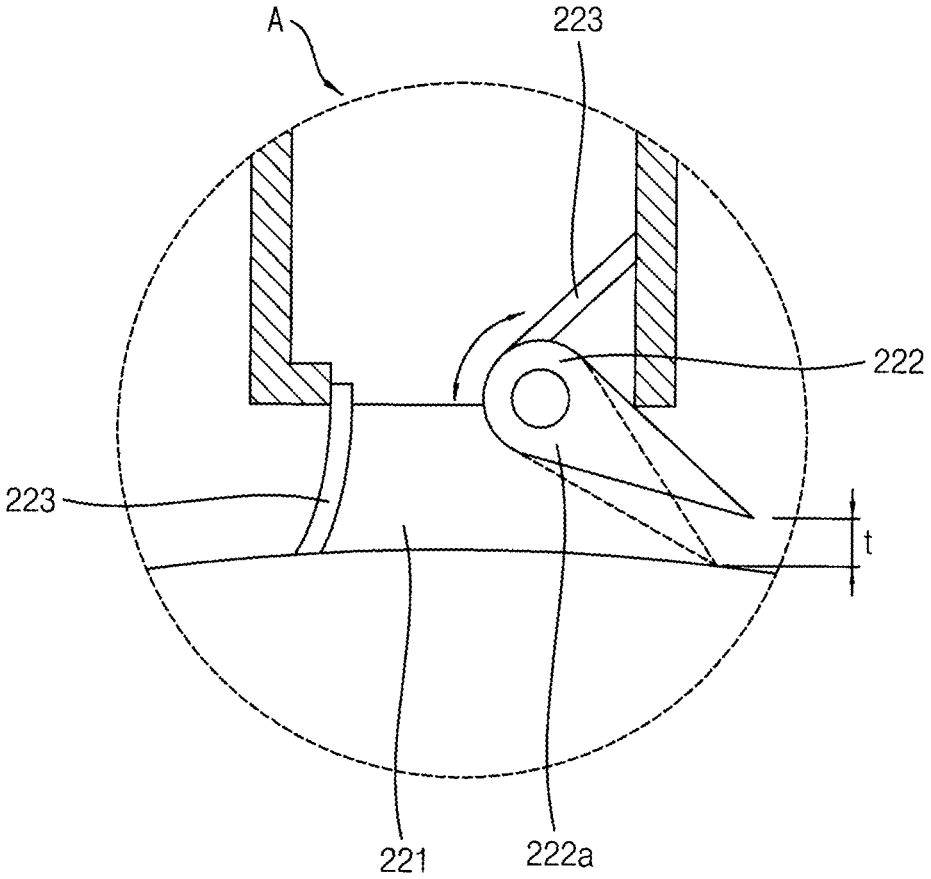
FIG. 4 is an enlarged view of portion 'A' in FIG. 2.
Figure 5A:
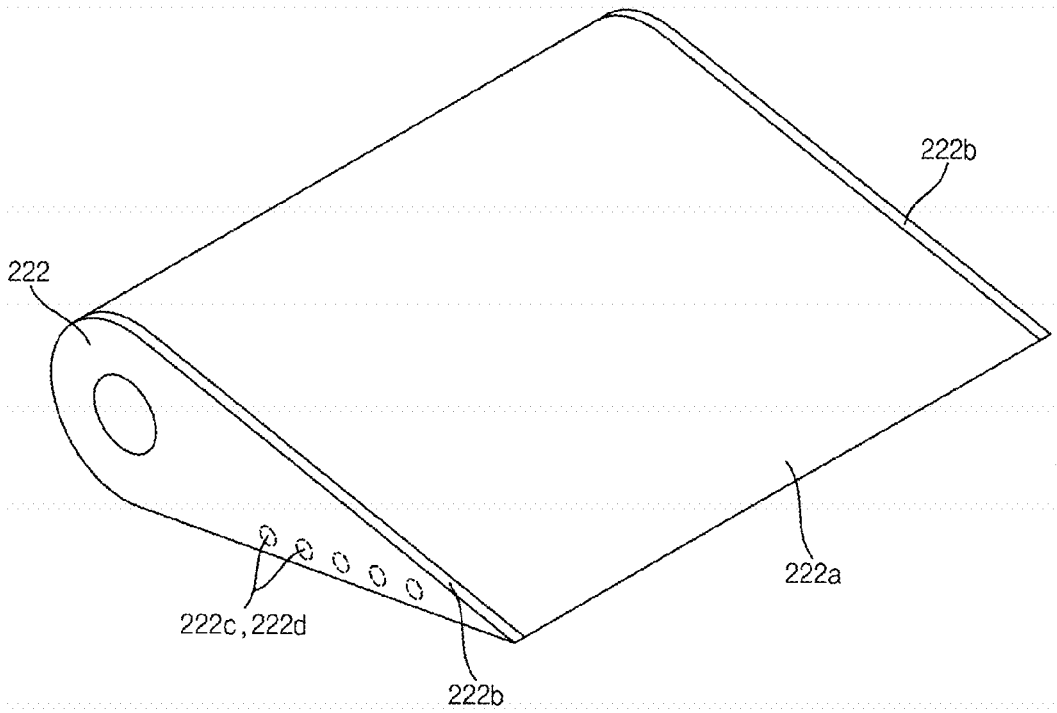
FIG. 5A is a perspective view illustrating a nozzle part in FIG. 4.
Figure 5B:
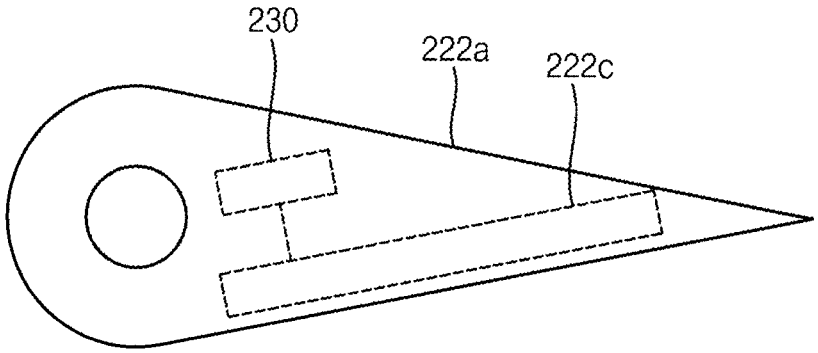
FIG. 5B is a side view illustrating an example heating part of the nozzle part in FIG. 3.
Figure 5C:
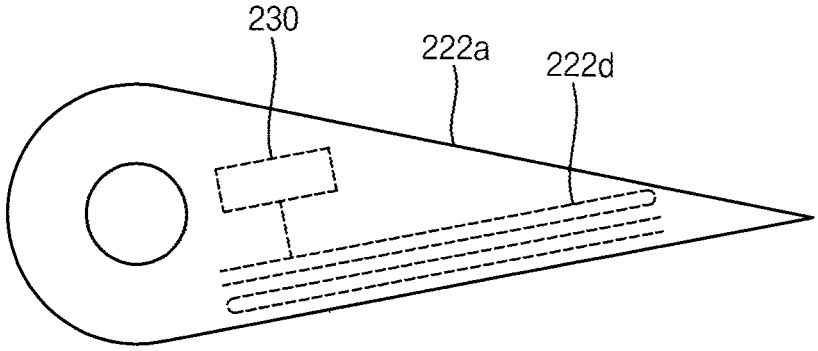
FIG. 5C is a side view illustrating another example heating part of the nozzle part in FIG. 3.
Figure 6A:
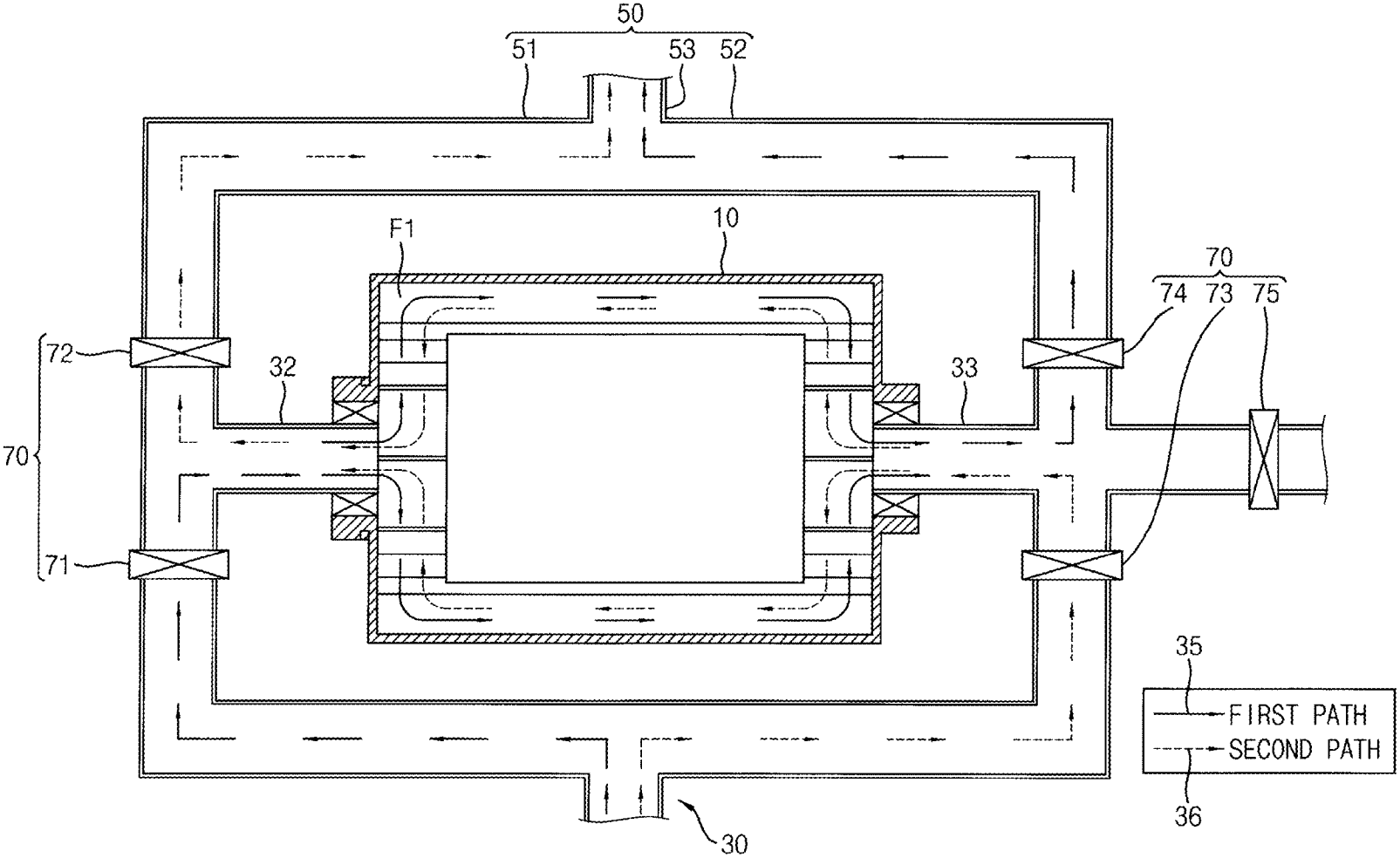
FIG. 6A is a block diagram illustrating an example path of a hot air in FIG. 1.
Figure 6B:
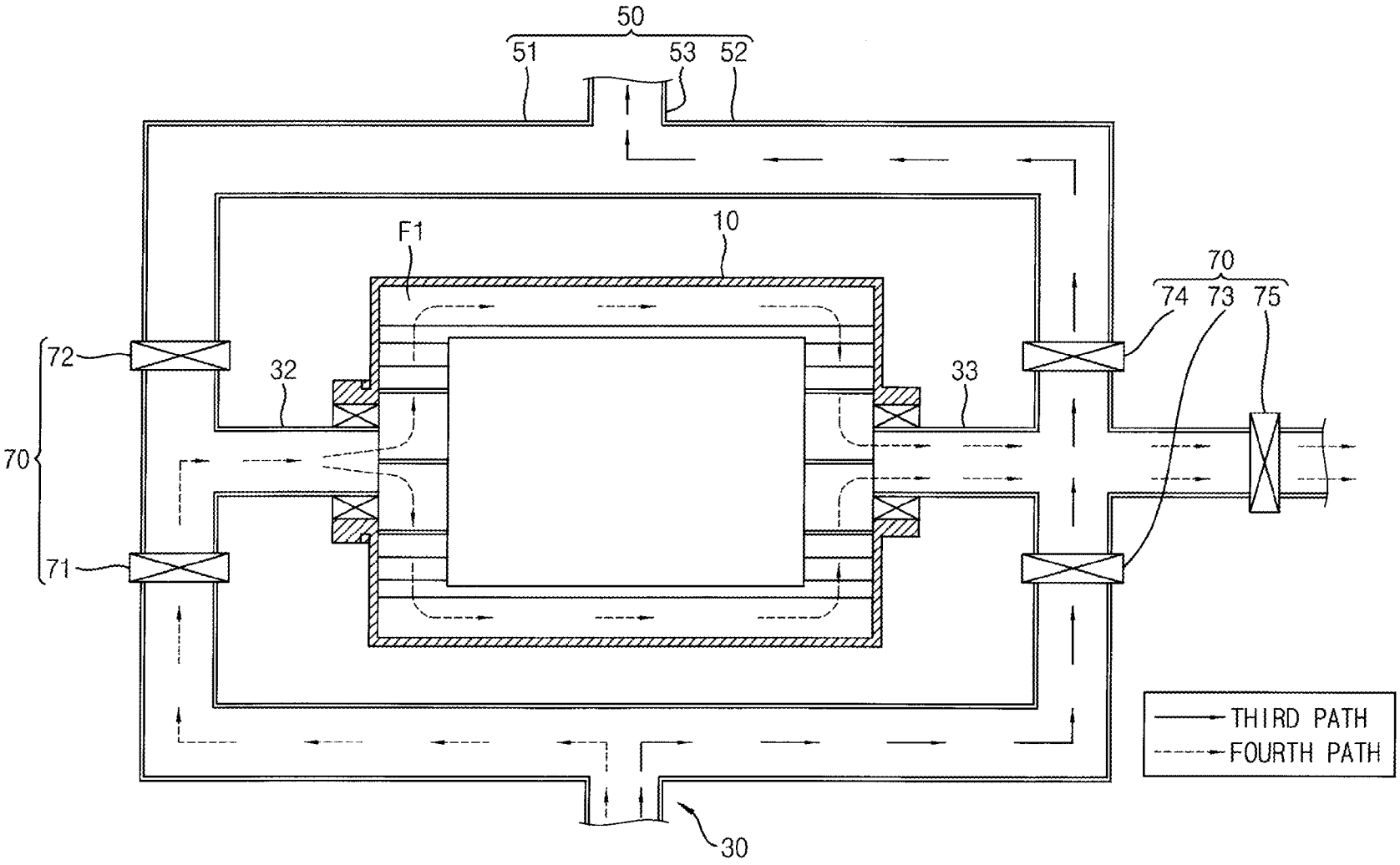
FIG. 6B is a block diagram illustrating another example path of a hot air in FIG. 1.
Figure 7:
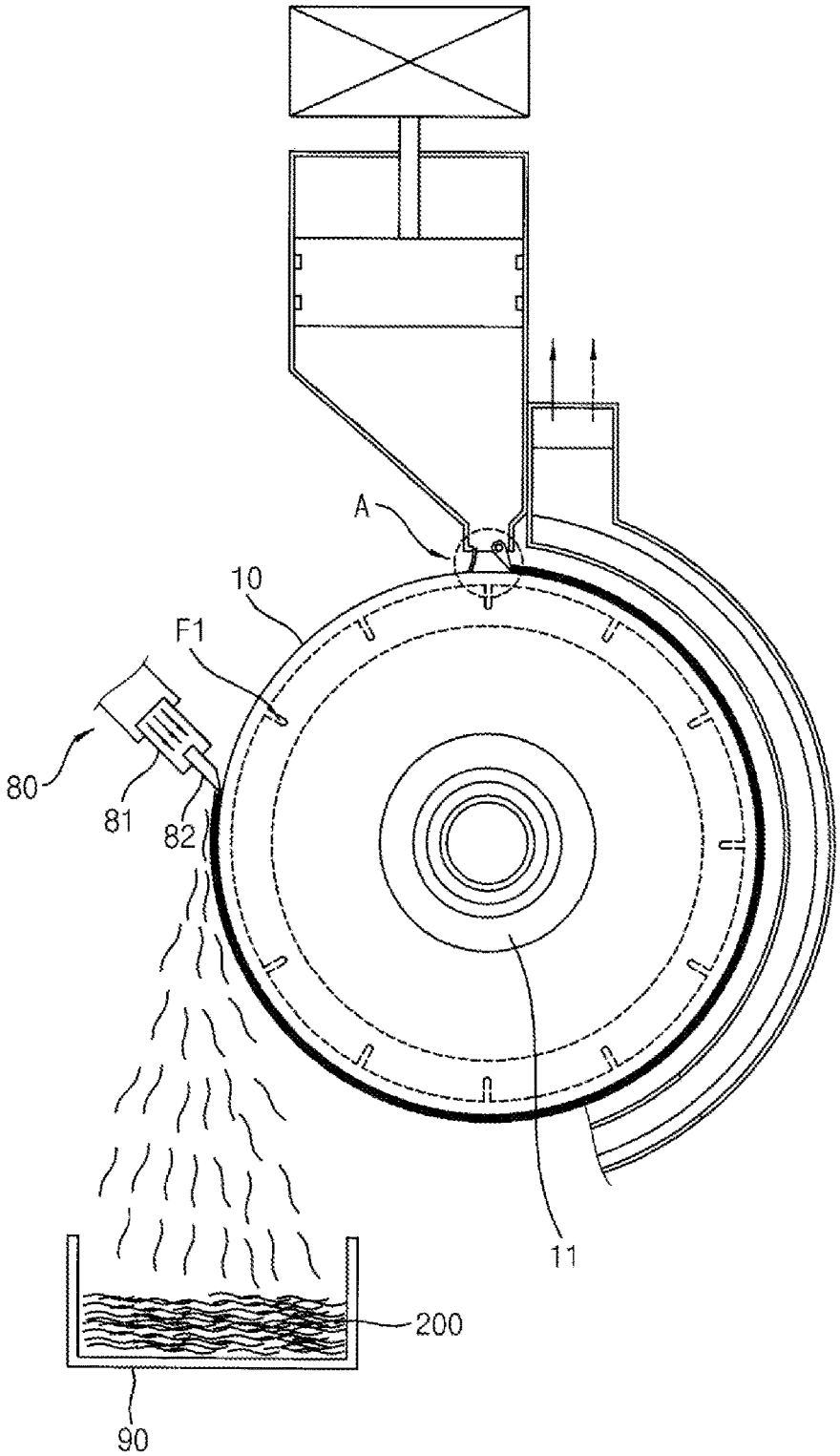
FIG. 7 is a cross-sectional view illustrating a retrieving process of a drying material using the complex type dryer in FIG. 1.

FIG. 1 is a perspective view illustrating a complex type dryer according to an example embodiment of the present invention. FIG. 2 is a cross-sectional view illustrating the complex type dryer in FIG. 2. FIG. 3 is a side view illustrating the complex type dryer in FIG. 3. FIG. 4 is an enlarged view of portion 'A' in FIG. 2. FIG. 5A is a perspective view illustrating a nozzle part in FIG. 4. FIG. 5B is a side view illustrating an example heating part of the nozzle part in FIG. 3, and FIG. 5C is a side view illustrating another example heating part of the nozzle part in FIG. 3. FIG. 6A is a block diagram illustrating an example path of a hot air in FIG. 1. FIG. 6B is a block diagram illustrating another example path of a hot air in FIG. 1. FIG. 7 is a cross-sectional view illustrating a retrieving process of a drying material using the complex type dryer in FIG. 1.

Referring to FIGS. 1 to 7, the complex type dryer according to the present example embodiment includes a rotational cylinder 10, a drying material provider 20, a hot air provider 30, a hot air chamber 40, a connecting part 50, a cover unit 60, a path controller 70 and a scraping unit 80.

The rotational cylinder 10 has a cylindrical shape, and rotates with respect to a central axis. The rotational cylinder 10 rotates based on a rotational power from a motor M transmitting through a belt B and a pulley 11.

Here, a drying material provided by the drying material provider 20 is coated on a surface of the rotational cylinder 10 with a thin film, and the hot air provided by the hot air provider 30 passes through the rotational cylinder 10.

Here, first guide pins F1 may extend in parallel on an inner surface of the rotational cylinder 10 along an extending direction of the rotational cylinder 10.

Thus, the hot air provided into the rotational cylinder 10 is guided by the first guide pins F1 and flows along the extending direction of the rotational cylinder 10. Here, the hot air flows along the inner surface of the rotational cylinder 10, and thus the drying material coated on the surface of the rotational cylinder 10 is dried.

The hot air inlet 12 is formed at both sides of the rotational cylinder 10, as illustrated in FIG. 1, and thus the hot air flows in. Here, the hot air inlet 12 is arranged in a zigzag shape, and thus the hot air may be induced to flow in more uniformly and efficiently.

The drying material provider 20 is disposed over the rotational cylinder 10, and coats the drying material 200 on the surface of the rotational cylinder 10. Here, the drying material 200 may be coated on the surface of the rotational cylinder 10 which rotates, with a thin film having a predetermined thickness.

The drying material provider 20 may provide the drying material 200 to the rotational cylinder 10, with various kinds of method although not shown in figure, and includes a slit 221 and a nozzle part 222 at an end portion of the drying material provider 20.

For example, the drying material 200 provided from the drying material provider 20 is coated on the surface of the rotational cylinder 10 with a thin film due to the slit 221 at the end portion of the drying material provider 20.

The drying material provider 20 discontinuously provides the drying material 200 using a piston. Alternatively, the drying material provider 20 may include an element providing the drying material 200 continuously unlike the piston.

A plurality of holes 25 is formed through side surfaces of the drying material provider 20 opposite to each other. Thus, as illustrated in FIG. 1, the hot air exhausting from an outlet portion 43 flows in the holes 25 formed through a first side of the drying material provider 20 through an additional tube, and then the hot air passes through the drying material provider 20 and exhausts from the holes 25 formed through a second side of the drying material provider 20 opposite to the holes 25 formed through the second side thereof.

Since the temperature of the hot air exhausting from the outlet portion 43 is high enough to be about 60° C., the hot air is recycled to pass through the drying material provider 20 for drying the drying material 200 firstly. Thus, the energy efficiency may be increased. Further, the temperature of the hot air exhausting from the drying material provider 20 is finally dropped to be about 30° C.

Here, the drying material 200 providing to the rotational cylinder 10 through the slit 221 is maintained to be a constant thickness due to the nozzle part 222, and is coated on the rotational cylinder 10.

For example, as illustrated in FIG. 4, the nozzle part 222 has a sector shape cross-section, and a pressuring blade 222*a* extends sharply.

In addition, the pressuring blade 222*a* initially makes contact with the surface of the rotational cylinder 10, and is spaced apart from the surface of the rotational cylinder 10 by a distance 't' when the drying material 200 is coated on the surface of the rotational cylinder 10.

Here, the distance T may be variously changed, to change the thickness of the drying material 200 coated on the rotational cylinder 10.

An angle between the pressuring blade 222*a* and the rotational cylinder 10 is maintained to be under 20°, and thus the drying material 200 having relatively high viscosity may be uniformly coated on the rotational cylinder 10.

In addition, referring to FIGS. 5A to 5C, a heating part 222*c* and 222*d* is inserted inside of the pressuring blade 222*a*. The heating part 222*c* and 222*d* provides heat for heating the nozzle part 222 to dry the drying material 200 firstly, and thus the drying material 200 having relatively high viscosity may be coated on the rotational cylinder 10 more uniformly.

Here, the heating part 222*c*, as illustrated in FIG. 5B, may be inserted as a heating plate shape adjacent to a contact portion between the drying material 200 and the pressuring blade 222*a*. Alternatively, the heating part 222*d*, as illustrated in FIG. 5C, may be inserted as a heating line shape adjacent to the contact portion between the drying material 200 and the pressuring blade 222*a*.

Further, the heating part 222*c* and 222*d* may be connected to a sensor 230 sensing the temperature of the heating part 222*c* and 222*d* to maintain proper temperature of the heating part 222*c* and 222*d*. In addition, the temperature of the heating part 222*c* and 222*d* may be controlled based on the temperature sensed by the sensor 230.

Here, the sensor 230 is inserted inside of the pressuring blade 222*a*, and is adjacent to the heating part 222*c* and 222*d*, to sense the temperature of the heating part 222*c* and 222*d*.

In addition, an insulating part 222*b* may be formed at both sides of the pressuring blade 222*a* to prevent the heat from the heating part 222*c* and 222*d* from being dissipated outside.

A silicon film 223 may be formed at the slit 221 to prevent the drying material 200 from being leaked to outside and to guide the drying material 200 toward the nozzle part 222.

The hot air provider 30 includes a ventilating fan 31, a first hot air tube 32 and a second hot air tube 33, and the hot air is provided inside of the rotational cylinder 10. Here, the first and second hot air tubes 32 and 33 are respectively connected to both sides of the rotational cylinder 10, and the hot air provided through the first and second hot air tubes 32 and 33 passes through the hot air inlet 12 to flow in the rotational cylinder 10.

For example, referring to FIGS. 1 and 6, in the present example embodiment, a direction of the hot air inside of the rotational cylinder 10 is periodically changed, to prevent the drying material 200 from being ununiformly dried when the hot air flow in one direction inside of the rotational cylinder 10.

The path controller 70 includes first to fifth control units 71, 72, 73, 74 and 75 to periodically change the direction of the hot air, and the first to fifth control units 71, 72, 73, 74 and 75 may be an electric control unit or an electric control valve opening or closing the path based on a control signal.

For example, as illustrated in FIG. 6A, when the fifth control unit 75 is closed, the hot air flows along a first path 35, as follows.

The hot air from the ventilating fan 31 is provided into the rotational cylinder 10 through the first hot air tube 32 with the first control unit 71 open and with the third control unit 73 closed. Then, the hot air passing through the rotational cylinder 10 is provided to a second inlet tube 52 of the connecting part 50 through the second hot air tube 33 with the second control unit 72 closed and with the fourth control unit 74 open. Then, the hot air exhausting from an outlet tube 53 of the connecting part 50 is provided to an inlet portion 42 of the hot air chamber 40.

Alternatively, when the fifth control unit 75 is closed, the hot air flows along a second path 36, as follows.

The hot air from the ventilating fan 31 is provided into the rotational cylinder 10 through the second hot air tube 33 with the first control unit 71 closed and with the third control unit 73 open. Then, the hot air passing through the rotational cylinder 10 is provided to a first inlet tube 51 of the connecting part 50 through the first hot air tube 32 with the second control unit 72 open and with the fourth control unit 74 closed. Then, the hot air exhausting from an outlet tube 53 of the connecting part 50 is provided to the inlet portion 42 of the hot air chamber 40.

The path controller 70 is controlled such that the hot air alternately passes through the first and second paths 35 and 36, and thus the drying material 200 may be dried more uniformly. Here, a pattern of the path of the hot air may be variously controlled based on the control of the path controller 70.

In FIG. 6A, the hot air flows to both of the rotational cylinder 10 and the hot air chamber 40 in the first and second paths 35 and 36.

Alternatively, referring to FIG. 6B, the hot air flows along the third path with the fifth control unit 75 closed, as follows.

The hot air from the ventilation fan 31 exhausts from the outlet tube 53 of the connecting part 50 and flows in the inlet portion 42 of the hot air chamber 40 without flowing into the rotational cylinder 10, with the first and second control units 71 and 72 closed and with the third and fourth control units 73 and 74 open.

Although not shown in the figure, the hot air exhausts from the outlet tube 53 of the connecting part 50 and flows in the inlet portion 42 of the hot air chamber 40 without flowing into the rotational cylinder 10, with the first and second control units 71 and 72 open and with the third and fourth control units 73 and 74 closed.

Accordingly, the hot air only passes through the hot air chamber 40 without passing through the rotational cylinder 10, based on the control of the path controller 70.

Further, referring to FIG. 6B, the hot air flows along the fourth path with the fifth control unit 75 open, as follows.

The hot air from the ventilation fan 31 flows into the rotational cylinder 10 through the first hot air tube 32, with the first control unit 71 open and with the second to fourth control units 72, 73 and 74 closed. Then, the hot air passing through the rotational cylinder 10 exhausts to outside through the fifth control unit 75 since the fifth control unit 75 is open, and thus the hot air does not flow in the hot air chamber 40.

Accordingly, the hot air only passes through the rotational cylinder 10 without passing through the hot air chamber 40, based on the control of the path controller 70.

The hot air chamber 40 includes a body portion 41, an inlet portion 42, an outlet portion 43 and a porous block 44.

The body portion 41 has a round shape along the outer surface of the rotational cylinder 10, and covers the outer surface of the rotational cylinder 10. The body portion 41 is spaced apart from the surface of the rotational cylinder 10.

The hot air chamber 40 dries the drying material 200 coated on the surface of the rotational cylinder 10 using the hot air passing through the hot air chamber 40. As an overlapping area between the outer surface of the rotational cylinder 10 and the hot air chamber 40 increases, the drying material is dried more efficiently.

Thus, in the present example embodiment, as illustrated in FIG. 2, the body portion 41 of the hot air chamber 40 is formed large enough to overlap with the rotational cylinder 10. For example, the body portion 41 may cover the outer surface of the rotational cylinder 10 between about a half and about three quarters.

The inlet portion 42 is connected to a first end of the body portion 41, and the hot air from the outlet tube 53 of the connecting part 50 flows in through the inlet portion 42. Here, a shape of the inlet portion 42 may be designed, as illustrated in FIG. 2, such that the hot air flows in the body portion 41 through the inlet portion 42 more effectively.

The outlet portion 43 is connected to a second end of the body portion 41, and the hot air passing through the body portion 41 exhausts through the outlet portion 43. Here, the outlet portion 43 is open toward an upper portion adjacent to the drying material provider 20, considering the position and the structure of the drying material provider 20.

The porous block 44 is disposed at the inlet portion 42, so that the hot air flowing through the inlet portion 42 passes through or are partially blocked by the porous block 44. Thus, the hot air may flow into the hot air chamber 40 more uniformly.

When the hot air does not pass through or is not blocked by the porous block 44, a velocity of the hot air flowing into the hot air chamber 40 is relatively higher and a pressure of the hot air flowing into the hot air chamber 40 is relatively increased. Thus, heat transfer may be ununiformed, and the hot air may be leaked to outside.

Thus, when the porous block 44 is disposed at the inlet portion 42, the velocity and the pressure of the hot air are decreased, so that the heat may be transferred more uniformly and the hot air may be prevented from being leaked.

As illustrated in FIG. 2, a height of the porous block 44 is lower than that of the inlet portion 42, and the porous block 44 partially block the inlet portion 42. Thus, the pressure of the hot air passing through the porous block 44 may be decreased and the hot air may pass through the hot air chamber 40 more uniformly.

For example, the height of the porous block 44 may be half of that of the inlet portion 42.

Accordingly, the hot air passing through the hot air chamber 40 additionally dries the drying material 200 coated on the rotational cylinder 10, and the drying material 200 may be dried more efficiently.

The rotational cylinder 10 is spaced apart from the hot air chamber 40 by a predetermined distance, and thus a space is formed between a side of the rotational cylinder 10 and a side of the hot air chamber 40. In addition, outer air may flow into the space, and thus the hot air passing through the rotational cylinder 10 and the hot air chamber 40 may be cooled down. Here, the drying material 200 may be less dried.

Thus, in the present example embodiment, a cover unit 60 is fixed at the side of the hot air chamber 40, and encloses the space between the side of the hot air chamber 40 and the side of the rotational cylinder 10.

Referring to FIGS. 1 and 3, the cover unit 60 is fixed to the hot air chamber 40 and the rotational cylinder 10 at the same time to enclose the side of the hot air chamber 40 and the rotational cylinder 10.

Here, the rotational cylinder 10 rotates and the hot air chamber 40 is fixed. Thus, an enclosing part 13 is additionally disposed at the side of the rotational cylinder 10, to minimize wear between the rotational cylinder 10 and the cover unit 60 even though the rotational cylinder 10.

Thus, the enclosing part 13 encloses the space between the rotational cylinder 10 and the cover unit 60, and minimizes the wear of the rotational cylinder 10 and the cover unit 60, at the same time.

Further, the enclosing part 13 includes a bearing, and thus the rotational cylinder 10 may rotate with respect to the cover unit 60 and the hot air chamber 40 and the wear may be minimized.

In addition, the surface of the rotational cylinder 10 is coated with relatively high hardness material such as chromium (Cr) and is heat-treated. Thus, the surface of the rotational cylinder 10 has relatively high hardness and has relatively high wear resistance.

Referring to FIGS. 2 and 7, the scraping unit 80 is disposed at a position through which the rotational cylinder 10 is exposed to outside since the hot air chamber 40 does not cover the rotational cylinder 10 at the position. For example, the scraping unit 80 may be disposed at a side upper position of the rotational cylinder 10.

The scraping unit 80 includes a fixing part 81 and a scraper 82.

An end of the scraper 82 extends sharply and makes contact with the rotational cylinder 10, and thus the scraper 82 removes the drying material 200 coated and dried on the rotational cylinder 10. Here, the scraper 82 may be a conventional blade, or may be designed to effectively remove the drying material 200.

The scraper 82 is fixed or supported by the fixing part 81, and is detached from the fixing part 81. Thus, the scraper 82 may be easily changed or repaired.

The fixing part 81 may be a zig fixing the scraper 82. When the scraper 82 is fixed by the fixing part 81, the fixing part 81 applies force or elastic force to the scraper 82 and thus the scraper 82 maintains predetermined force or elastic force in making contact with the rotational cylinder 10. Thus, the drying material 200 is removed with predetermined force or pressure, and the drying material 200 may be removed more efficiently.

Accordingly, the drying material 200 removed by the scraper 82 may be collected by a receiver 90.

Figure 8:
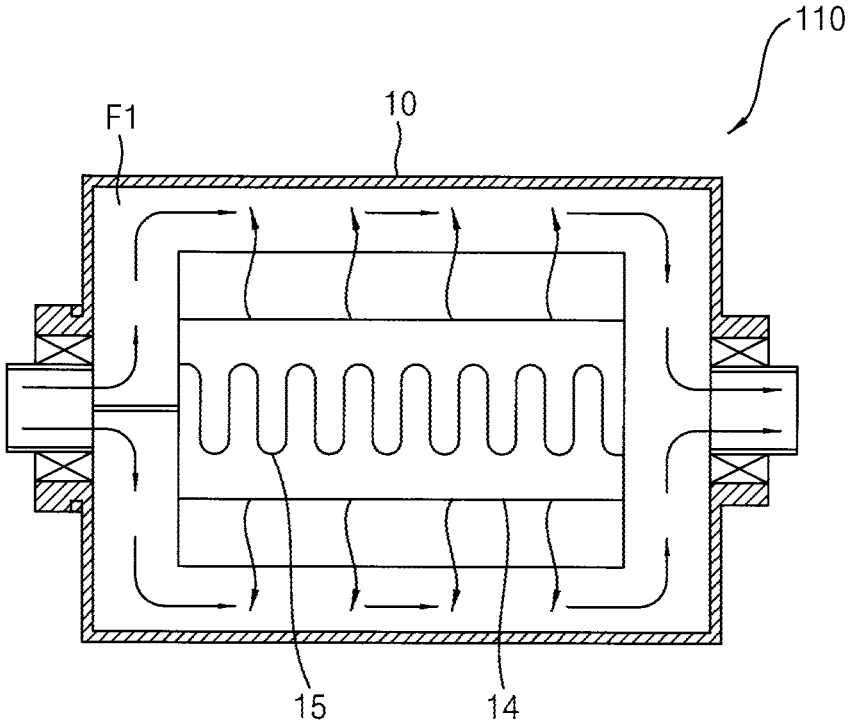
FIG. 8 is a cross-sectional view illustrating an inside of a rotational cylinder of a complex type dryer according to another example embodiment of the present invention.

FIG. 8 is a cross-sectional view illustrating an inside of a rotational cylinder of a complex type dryer according to another example embodiment of the present invention.

The complex type dryer 110 according to the present example embodiment is substantially same as the complex type dryer 100 in FIGS. 1 to 7, except for an inner structure of the rotational cylinder 10. Thus, same reference numerals are used and any repetitive explanation will be omitted.

Referring to FIG. 8, the complex type dryer 110 according to the present example embodiment includes a light emitting unit 14 inside of the rotational cylinder 10.

The light emitting unit 14 may be disposed at a central portion of the rotational cylinder 10. Further, the light emitting unit 14 may be disposed at a side of the pulley 11 among the central portion of the rotational cylinder 10, considering the central portion of the rotational cylinder 10 is fixed by the pulley 11.

The light emitting unit 14 includes a filament 15 inside thereof, and emits a radiant energy to outside. The filament 15 may be a tungsten alloy filament.

For example, the light emitting unit 14 is disposed inside of the rotational cylinder 10 and emits the radiant energy toward the space through which the hot air flows, and the radiant energy is provided to the surface of the rotational cylinder 10 to dry the drying material coated on the surface of the rotational cylinder 10 additionally.

The rotational cylinder 10 may include a material such as quartz, such that the structure of the rotational cylinder 10 may be stable at a relatively high temperature state due to the emission of the radiant energy, and transmittance of the radiant energy may be relatively high.

Accordingly, when the rotational cylinder 10 includes quartz, the first guide pins F1 may not be formed on the inner surface of the rotational cylinder 10.

Although not shown in the figure, the complex type dryer 110 may further include a controller controlling a quantity of the radiant energy emitted from the light emitting unit 14 and a quantity of the hot air flowing into the rotational cylinder 10, to maintain the temperature of the surface of the rotational cylinder 10 uniformly.

The controller controls the quantity of the radiant energy emitted from the light emitting unit 14 and the quantity of the hot air flowing into the rotational cylinder 10, based on the temperature of the surface of the rotational cylinder 10 or the temperature of the drying material coated on the surface of the rotational cylinder 10.

Here, the quantity of the radiant energy may be controlled via changing a current applied to the filament 15.

Thus, the temperature of the surface of the rotational cylinder 10 may be uniformly maintained, and the drying material may be uniformly dried.

Figure 9:
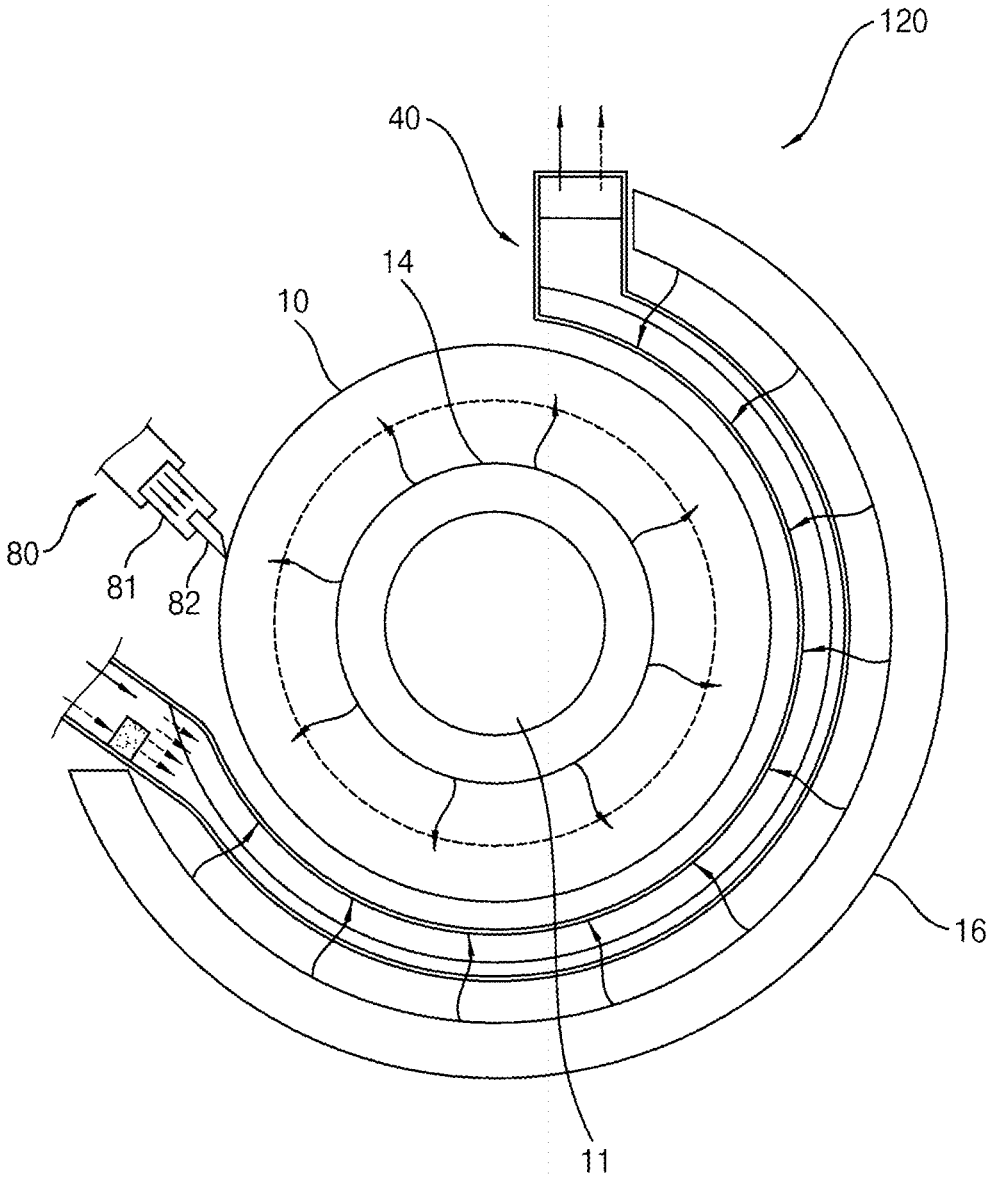
FIG. 9 is a cross-sectional view illustrating a portion of a complex type dryer according to still another example embodiment of the present invention.

FIG. 9 is a cross-sectional view illustrating a portion of a complex type dryer according to still another example embodiment of the present invention.

The complex type dryer 120 according to the present example embodiment is substantially same as the complex type dryer 100 in FIGS. 1 to 7, and thus same reference numerals are used and any repetitive explanation will be omitted.

Referring to FIG. 9, the complex type dryer 120 further includes a light emitting cover 16.

The light emitting cover 16 is disposed to cover the outside of the hot air chamber 40.

Here, the light emitting cover 16 includes a heat source inside thereof, and the radiant energy may be emitted toward the hot air chamber 40. The radiant energy emitted from the light emitting cover 16 passes through the hot air chamber 40 and is provided to the drying material coated on the surface of the rotational cylinder 10, and thus the drying material may be dried more efficiently.

Likewise, the rotational cylinder 10, as explained referring to FIG. 8, may include a material such as quartz, such that the structure of the rotational cylinder 10 may be stable at a relatively high temperature state due to the emission of the radiant energy, and transmittance of the radiant energy may be relatively high. In addition, when the rotational cylinder 10 includes quartz, the first guide pins F1 may not be formed on the inner surface of the rotational cylinder 10.

Figure 10A:
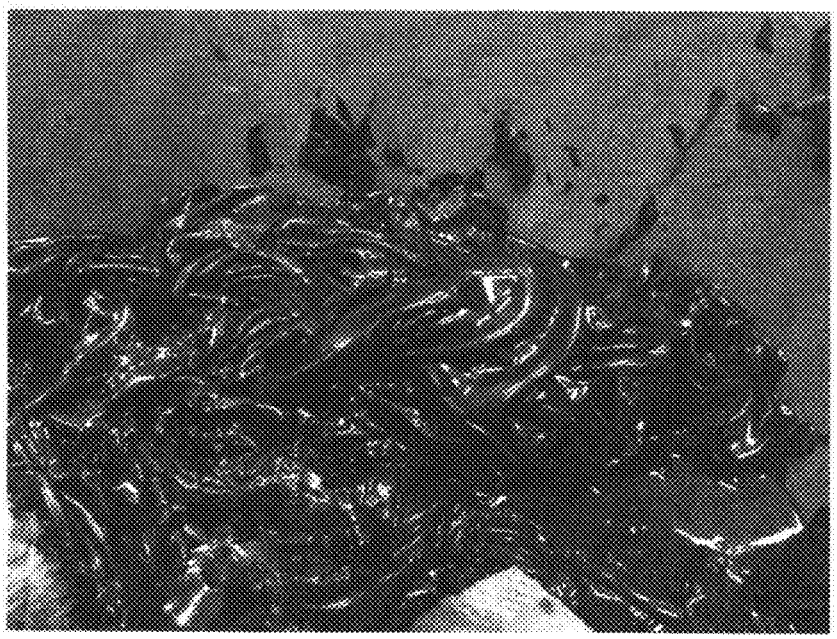
FIGS. 10A and 10B are images illustrating the drying material before and after drying using the complex type dryer in FIGS. 1, 8 and 9.
Figure 10B:
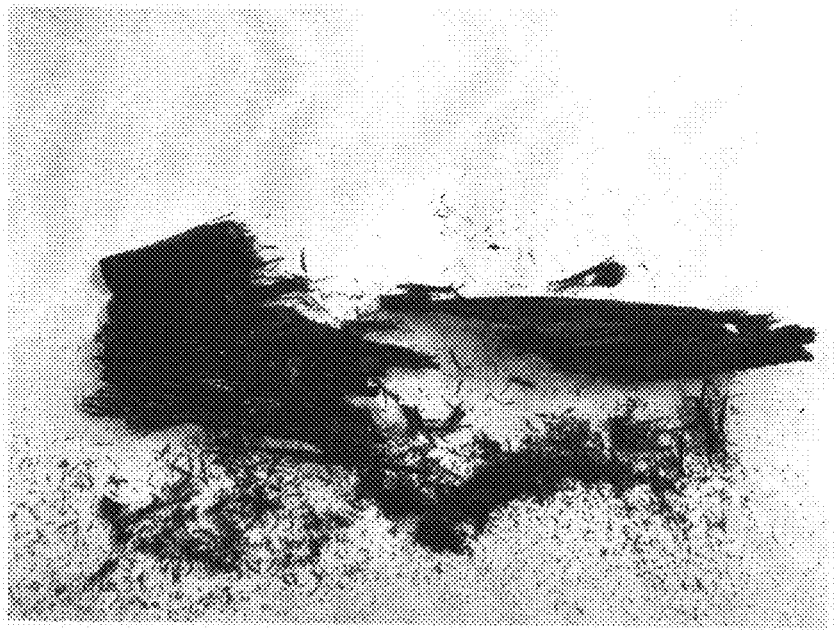

FIGS. 10A and 10B are images illustrating the drying material before and after drying using the complex type dryer in FIGS. 1, 8 and 9.

A microalgae having high viscosity is illustrated in FIG. 10A, before the microalgae is dried using the complex type dryer according to the example embodiments mentioned above. A power type microalgae is illustrated in FIG. 10B, after the microalgae is dried using the complex type dryer according to the example embodiments mentioned above.

Accordingly, the complex type dryer according to the present example embodiments may efficiently dry the material having relatively high viscosity to be a power type material.

According to the example embodiments of the present invention, the hot air is alternately provided from the rotational cylinder by the hot air provider, to prevent the drying material from be ununiformly dried due to the hot air from one side of the rotational cylinder, and thus the drying material may be dried more uniformly.

The first and second hot air tubes are respectively connected to both sides of the rotational cylinder, and the providing and the exhausting of the hot air to the first and second hot air tubes are controlled, so that the drying material may be more effectively dried.

The path of the hot air may be controlled toward the rotational cylinder or toward the hot air chamber based on user's selection, and thus the drying material may be more effectively dried.

In addition, the hot air inlet is arranged by a zigzag shape at both sides of the rotational cylinder, and thus the hot air may flow in the rotational cylinder more efficiently.

In addition, an end portion of the nozzle part coating the drying material on the surface of the rotational cylinder is sharped, and the heating part is inserted into the nozzle part, so that the drying material may be heated and dried firstly. Thus, the drying material may be coated on the surface of the rotational cylinder more uniformly.

The heating part includes a heating plate or a heating line providing the heat, and the heat may be prevented from being dissipated by the insulating part. Thus, the energy may be less lost.

In addition, the hot air chamber covers between a half and three quarters of the outer surface of the rotational cylinder, which is relatively larger covering area, and thus the drying material coated on the rotational cylinder may be dried more efficiently.

In addition, the scraper of the scraping unit is detachable, and thus the scraper may be easily repaired or changed. A uniform force is applied to the scraper, and thus the drying material may be uniformly and effectively removed.

In addition, the cover unit encloses the space between the rotational cylinder and the hot air chamber to minimize leakage of the hot air, and thus the moisture evaporated from the drying material is easily exhausted without a drop of temperature and the drying material may be dried more efficiently.

The side surface between the cover unit and the rotational cylinder is enclosed by the enclosing part to minimize the leakage of the hot air, and the enclosing part includes a bearing and thus the rotational cylinder rotates with respect to the cover unit.

In addition, the light emitting unit is inside of the rotational cylinder and a radiant energy is provided to the surface of the rotational cylinder, and thus the drying material may be dried more efficiently. Here, a quantity of the radiant energy and the hot air may be controlled to dry the drying material more efficiently.

In addition, the light emitting cover covering the outside of the hot air chamber provides the radiant energy to the drying material of the rotational cylinder, and thus the drying material may be dried more efficiently.

The foregoing is illustrative of the present teachings and is not to be construed as limiting thereof. Although a few exemplary embodiments have been described, those skilled in the art will readily appreciate from the foregoing that many modifications are possible in the exemplary embodiments without materially departing from the novel teachings and advantages of the present disclosure of invention. Accordingly, all such modifications are intended to be included within the scope of the present teachings. In the claims, means-plus-function clauses are intended to cover the structures described herein as performing the recited function and not only structural equivalents but also functionally equivalent structures.

What is claimed is:

1. A complex type dryer comprising:

a rotational cylinder;

a drying material provider disposed over the rotational cylinder and coating a drying material on a surface of the rotational cylinder;

a hot air provider connected to both sides of the rotational cylinder, and comprising first and second hot air tubes, the first and second hot air tubes alternately providing a hot air into the rotational cylinder or alternately exhausting the hot air passing through the rotational cylinder;

a hot air chamber disposed along an outer surface of the rotational cylinder outside of the rotational cylinder, the hot air which is re-provided after passing through the rotational cylinder passing through the hot air chamber;

a scraping unit disposed at a side of the rotational cylinder, and removing the drying material from the surface of the rotational cylinder after dried by the rotational cylinder and the hot air chamber; and a connecting part receiving the hot air passing through the rotational cylinder and re-providing the heat to the hot air chamber, wherein the hot air is sequentially provided to the first hot air tube, the rotational cylinder, the second hot air tube, the connecting part and the hot air chamber, which is a first path, or the hot air is sequentially provided to the second hot air tube, the rotational cylinder, the first hot air tube, the connecting part and the hot air chamber, which is a second path.

2. The complex type dryer of claim 1, wherein a first guide pin is formed inside of the rotational cylinder and guides the hot air alternately provided by the first and second hot air tubes, wherein hot air inlets are arranged at both sides of the rotational cylinder, and the hot air provided by the first and second hot air tubes flows in through the hot air inlets.

3. The complex type dryer of claim 2, wherein the hot air inlets are arranged in a zigzag shape along a circumference of both sides of the rotational cylinder connected to the first and second hot air tubes.

4. The complex type dryer of claim 1, wherein the drying material provider comprises a slit and a nozzle part, wherein the slit is disposed at an end portion of the drying material provider and the drying material flows out through the slit, wherein the nozzle part is fixed to at a side of the slit and coats the drying material to be a film on the surface of the rotational cylinder, wherein the nozzle part has a sector shape cross-section and an end portion of the nozzle part is spaced apart from the surface of the rotational cylinder by a predetermined distance.

5. The complex type dryer of claim 4, wherein the nozzle part comprises a heating part disposed inside of the nozzle part and providing a heat to the nozzle part.

6. The complex type dryer of claim 5, wherein the heating part is a heating plate or a heating line.

7. The complex type dryer of claim 5, wherein an insulating part is formed at both sides of the nozzle part to prevent the heat from dissipating to outside.

8. The complex type dryer of claim 1, further comprising a path controller controlling the hot air path to provide the hot air alternately along the first and second paths.

9. The complex type dryer of claim 1, wherein the hot air is provided only to the hot air chamber without passing through the rotational cylinder, which is a third path, or the hot air is sequentially provided to the first hot air tube, the rotational cylinder and the second hot air tube, which is a fourth path.

10. The complex type dryer of claim 1, wherein the hot air chamber comprises an inlet portion through which the hot air flows in, an outlet portion through which the hot air flows out, and a body portion between the inlet and outlet portions and through which the hot air passes, wherein the body portion covers between a half and three quarters of the outer surface of the rotational cylinder.

11. The complex type dryer of claim 10, wherein the hot air chamber further comprises a porous block disposed at the inlet portion to increase uniformity of the hot air flowing in the hot air chamber.

12. The complex type dryer of claim 1, wherein the scraping unit comprises:

a scraper removing the drying material; and a fixing part fixing the scraper which is detachable.

13. The complex type dryer of claim 12, wherein the scraping unit is disposed between the drying material provider and an end portion of the hot air chamber, wherein the fixing part applies a force to the scraper to stick the scraper fast to the rotational cylinder.

14. The complex type dryer of claim 1, further comprising a cover unit covering the side of the rotational cylinder and a side of the hot air chamber at the same time to enclose a space between the rotational cylinder and the hot air chamber.

15. The complex type dryer of claim 1, wherein the rotational cylinder further comprises an enclosing part fixing to a side surface of the rotational cylinder and making contact with a cover unit, to enclose a space between the rotational cylinder and the cover unit.

16. The complex type dryer of claim 15, wherein the enclosing part comprises a bearing inducing the rotational cylinder to rotate with respect to the cover unit.

* * * * *